US010062972B1

(12) United States Patent
Strassner, II

(10) Patent No.: US 10,062,972 B1
(45) Date of Patent: Aug. 28, 2018

(54) ANTENNA ARRAY WITH LOW RX AND TX SIDELOBE LEVELS

(71) Applicant: National Technology & Engineering Solutions of Sandia, LLC, Albuquerque, NM (US)

(72) Inventor: Bernd H. Strassner, II, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 794 days.

(21) Appl. No.: 13/868,864

(22) Filed: Apr. 23, 2013

(51) Int. Cl.
*H01Q 21/00* (2006.01)
*H01P 3/08* (2006.01)

(52) U.S. Cl.
CPC ..... *H01Q 21/0075* (2013.01); *H01P 3/088* (2013.01)

(58) Field of Classification Search
CPC ..... H01Q 1/38; H01Q 21/0075; H01P 3/088
USPC ..... 343/700 MS, 850
See application file for complete search history.

(56) References Cited

U.S. PATENT DOCUMENTS 3,916,417 A * 10/1975 Wong ..... H01Q 21/22 342/373
4,875,087 A * 10/1989 Miyauchi ..... H01L 23/642 257/664
5,661,494 A * 8/1997 Bondyopadhyay .... H01Q 1/364 343/700 MS
5,933,115 A * 8/1999 Faraone ..... H01Q 1/38 343/700 MS
6,114,997 A * 9/2000 Lee ..... H01Q 1/38 343/700 MS
6,229,484 B1 * 5/2001 Sagisaka ..... H01Q 21/065 343/700 MS (Continued)

FOREIGN PATENT DOCUMENTS

JP 05291814 A * 11/1993

OTHER PUBLICATIONS

Kuo, et al., "A Density Taper Technique for Low Side Lobe Applications of Hex Array Antennas", Phased Array Systems and Technology, 2000 IEEE International Conference Proceedings, 2000, pp. 493-496.

*Primary Examiner* — Dieu H Duong
(74) *Attorney, Agent, or Firm* — Medley, Behrens & Lewis, LLC

(57) ABSTRACT

The various technologies presented herein relate to mitigating or reducing sidelobe levels during operation of an antenna array. Power coefficients operating across an antenna array are tapered to facilitate a power concentration at central region of the antenna array while power coefficients of a lower magnitude are generated at the periphery of the antenna array. Power coefficient variation can be effected by at least one of electrical path length, number of antennas being powered in a particular antenna subarray, a number of T-splitters incorporated into an electrical path servicing an antenna, etc. Electrical coupling of a pre-T/R stripline and a post-T/R stripline can be achieved in conjunction with operation with a dielectric layer, wherein the dielectric layer acts as a dielectric at the $K_u$ frequency band. Further, phase delay can be applied to at least one electrical signal to facilitate concurrent delivery of power across the antenna array.

10 Claims, 13 Drawing Sheets

FIG. 4

(56) References Cited

U.S. PATENT DOCUMENTS

| | | | | |
|---|---|---|---|---|
| 6,320,542 | B1 * | 11/2001 | Yamamoto | H01Q 1/38 343/700 MS |
| 7,805,116 | B2 | 9/2010 | Xu et al. | |
| 8,115,679 | B2 | 2/2012 | Falk | |
| 8,354,960 | B2 | 1/2013 | Krich et al. | |
| 8,405,564 | B2 | 3/2013 | Kindt et al. | |
| 2005/0110681 | A1 * | 5/2005 | Londre | H01Q 25/00 343/700 MS |
| 2006/0160500 | A1 * | 7/2006 | Ammar | H01L 23/04 455/118 |
| 2010/0026584 | A1 * | 2/2010 | Nakabayashi | H01Q 21/065 343/700 MS |
| 2013/0057445 | A1 | 3/2013 | Simms et al. | |

* cited by examiner

ANTENNA ARRAY WITH LOW RX AND TX SIDELOBE LEVELS

STATEMENT OF GOVERNMENTAL INTEREST

This invention was developed under contract DE-AC04-94AL85000 between Sandia Corporation and the U.S. Department of Energy. The U.S. Government has certain rights in this invention.

BACKGROUND

Sidelobes are encountered in antenna engineering where one or more portions of a radiation pattern do not form a main lobe (e.g., acting in a preferred direction), but rather are formed at various undesired angles and/or directions relative to the main lobe. FIG. 17 provides a representation of a main lobe in conjunction with a plurality of sidelobes. As illustrated in FIG. 17, a main lobe 1710 is engendered in a desired direction (i.e., the main lobe axis). However, rather than all of the radiation pattern forming the main lobe, as illustrated, sidelobes 1720 and a backlobe 1730 can also be formed. Hereinafter the sidelobes 1720 and backlobe 1730 are referred to in combination as sidelobes 1720. In transmitting antennas, excessive sidelobe radiation can waste energy and may cause interference to other equipment operating in conjunction with an antenna array. In receiving antennas, sidelobes may cause interfering signals to be detected, and further increase the noise level in the receiver leading to degradation in signal quality.

An approach to overcome such potentially deleterious effects is to utilize one or more attenuators to facilitate a reduction in the magnitude of the sidelobes 1720. However, antenna systems may be utilized in a lower power system, such as an unmanned aerial vehicle (UAV) which has limited onboard power, and hence, energy consumption of an antenna system is to be minimized as a function of increasing the operational capability (e.g., range, flight time) of the UAV.

In another approach, an array of sub-antennas can be employed to reduce magnitude of sidelobes, where sub-antennas in the array are designed to operate in a specific manner to minimize the occurrence of the sidelobes 1720. Such an array, however, may require a plurality of different sub-antenna configurations to achieve the required operational differences between a first sub-antenna (or first radiator) and a second sub-antenna (or second radiator). For example, in a system where the sub-antennas are formed on a supporting substrate, one or more vias may be required to electrically couple one layer (e.g., a ground layer) with a second layer (e.g., a transmission/receive (T/R) stripline), whereby to achieve a desired effect, placement of respective vias may differ between the first sub-antenna and the second sub-antenna. Furthermore, even though a via connects one electrical path with another electrical path, a single via may not be sufficient to direct a desired volume of electrical energy from the first layer to the second layer, and hence a plurality of vias (e.g., a via field) may be necessary to facilitate the desired transfer of electrical energy across the various sub-antenna layers. Vias can also fail (e.g., owing to thermal cycling during operation of an antenna array) which can negatively affect the reliability of an antenna array.

Thus, while an antenna array, either comprising a single radiator element or a plurality of radiator elements, provides the 'eye to the world' for a system (e.g., a UAV), numerous considerations affect applicability and operation of the antenna array. For example, numerous phase array antennas are in operation but are narrow band, e.g., approx. 5% fractional bandwidth, operating with sidelobe levels (SLLs) of approximately 20 dB. Thus, numerous challenges face an antenna designer in achieving increased bandwidth, improved SLLs, reduction in component complexity, while keeping to an absolute minimum power requirements for operation of the antenna.

SUMMARY

The following is a brief summary of subject matter that is described in greater detail herein. This summary is not intended to be limiting as to the scope of the claims.

Various exemplary embodiments presented herein relate to mitigation and/or reduction of SSL during operation of an antenna array. In an exemplary, non-limiting embodiment, an antenna array can include a plurality of antenna subarrays, wherein each antenna subarray in the plurality of antenna subarrays can include at least one radiator element comprising an antenna. In an embodiment, the at least one radiator element operates in accord with a power coefficient, the power coefficient being a function of a number of radiator elements comprising an antenna subarray.

A further exemplary, non-limiting embodiment for mitigating and/or reducing occurrence of SSL during operation of an antenna array comprises a array, where the array can include a pre-transmit/receive (T/R) stripline layer, a post-T/R stripline layer, and a dielectric layer located between the pre-T/R stripline layer and the post-T/R stripline layer. In an embodiment, when operating the array at an operating frequency the dielectric layer electrically couples the pre-T/R stripline layer and the post-T/R stripline layer.

Another exemplary, non-limiting embodiment comprises a method for mitigating and/or reducing SSL during operation of an antenna array is presented. The method comprising adjusting at least one power coefficient in an antenna array. In an embodiment, adjusting of the at least one power coefficient in the antenna array comprises dividing a plurality of antennas forming the antenna array into a plurality of subarrays, wherein each subarray comprising at least one antenna. In a further embodiment, a first T-splitter can be incorporated into a first electrical circuit forming a first antenna subarray in the plurality of subarrays, wherein the first antenna subarray comprising a first antenna and a second antenna. In another embodiment, a second T-splitter and a third T-splitter can be incorporated into a second electrical circuit forming a second antenna array in the plurality of subarrays, wherein the second antenna subarray comprising a third antenna, a fourth antenna and a fifth antenna.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
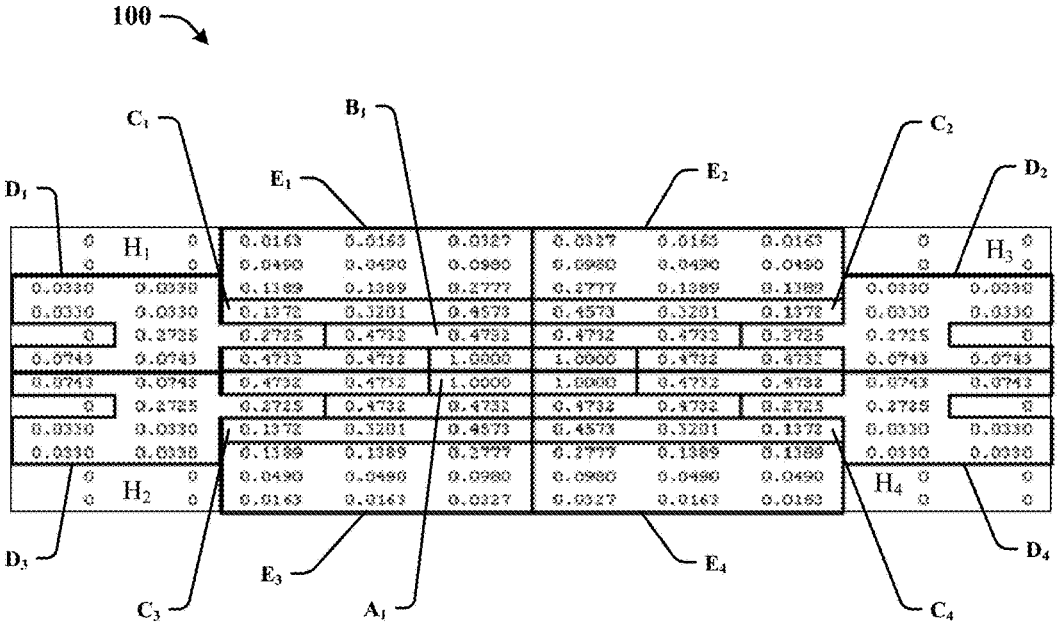
FIG. 1 is a block diagram illustrating exemplary embodiments for mitigation/reduction of SSL during operation of an antenna array.

Various technologies pertaining to mitigation and/or reduction of sidelobe formation in an antenna array to minimize any deleterious effects engendered by sidelobe existence are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something, and is not intended to indicate a preference.

As noted above, exemplary embodiments presented herein relate to mitigation and/or reduction of sidelobe formation in an antenna array to minimize any deleterious effects engendered by sidelobe existence. Further, common radiator components are utilized across the antenna assembly with attention paid to constructing an array of low complexity, whereby the radiator components do not utilize vias to facilitate coupling of the various layers/components comprising a radiator component. Utilizing common components throughout the antenna assembly facilitates reduced manufacturing complexity and cost in relation to a conventional system utilizing an amalgamation of disparate components. Furthermore, based upon such considerations as electrical path length (e.g., a stripline feed network length), feedline loss, power-divider location, power amplifier location, etc., attenuators are not utilized in the antenna array. In an embodiment, a tapered aperture approach, as engendered by utilizing different power coefficients acting on a number of antenna elements comprising the antenna array, eliminates the requirement for attenuation to be applied to each antenna element, which improves the energy efficiency of the antenna array presented herein in accord with one or more embodiments compared with a conventional, attenuated array. Owing to common T/R modules being utilized across the antenna array, whereby the common T/R modules can be operated under the same conditions (e.g., any of a common power, common biasing, amplification driven to 1 dB compression, etc.) facilitates operation with a wideband performance, which corresponds to high resolution for a given bandwidth. In another embodiment, phase delay can be utilized to facilitate concurrent delivery of power to each antenna element, e.g., irrespective of an electrical path length, etc., power arrives at each of the antenna elements at the same time. The various, exemplary, non-limiting embodiments are now described with reference to the drawings, wherein like reference numerals are used to refer to like elements throughout.

Power Coefficients and Aperture Tapering

FIG. 1 illustrates an antenna array and associated power coefficients according to an exemplary embodiment. As previously mentioned, in the various embodiments presented herein, attenuators are not required to facilitate minimization of sidelobes in an antenna array. As shown in FIG. 1, and as described further herein, advantage can be taken of line losses, etc., in conjunction with placement of T-splitters to effect control of power delivered to one or more radiator elements which comprise an antenna array. As further described below, an aperture weighting scheme having low sidelobes is presented. An irregular subarray approach is used in which the power coefficients, contained within different sized subarrays, are directed towards unity, with the resulting power coefficients being a function of a number of radiator elements comprising a subarray, electrical path length of the subarray electrical circuit, etc.

In the exemplary embodiment presented in FIG. 1, an exemplary antenna array is formed comprising 100 radiating elements, where each radiating element has an associated power coefficient. Radiating elements can be grouped into units (e.g., subarrays) to effect the desired minimization of sidelobe formation without the need for any associated attenuation circuitry. As shown in FIG. 1, a centralized region comprises four subarrays, each comprising a single radiator element, where each radiator element is operating with a power coefficient of 1.0000. To aid readability, only one of the four subarrays is identified (e.g., $A_1$ of $A_1$-$A_4$); however, it is to be appreciated that four subarrays are illustrated, each comprising a single radiating element.

Surrounding the central four subarrays are eight subarrays, where each subarray comprises two radiating elements, where each radiator element has a power coefficient of 0.4732. Again, to aid readability, only one of the eight subarrays is identified (e.g., $B_1$ of $B_1$-$B_8$), however it is to be appreciated that eight subarrays are illustrated, each comprising of a pair of radiating elements.

Further surrounding the eight subarrays $B_1$-$B_8$ are four subarrays, $C_1$-$C_4$, each comprising three radiating elements, with a first radiating element having a power coefficient of 0.4573, a second radiating element having a power coefficient of 0.3201, and a third radiating element having a power coefficient of 0.1372.

Further surrounding the eight subarrays $B_1$-$B_8$ are four subarrays, $D_1$-$D_4$, each subarray comprising eight radiating elements, with a first and second radiating elements each having a power coefficient of 0.2725, a third, fourth, fifth and sixth radiating elements each having a power coefficient of 0.0330, and a seventh and eighth radiating elements each having a power coefficient of 0.0743.

Four further subarrays, $E_1$-$E_4$ are incorporated into the antenna array 100, each subarray comprising nine radiating elements, with a first radiating element having a power coefficient of 0.2777, a second and third radiating elements each having a power coefficient of 0.1389, a fourth radiating element having a power coefficient of 0.0980, a fifth and sixth radiating elements each having a power coefficient of 0.0490, a seventh radiating element having a power coefficient of 0.0327, and an eighth and ninth radiating elements each having a power coefficient of 0.0163.

It is to be appreciated that the antenna array presented in FIG. 1, is an exemplary arrangement to facilitate understanding of the various concepts presented herein. Accordingly, the various embodiments presented herein are not limited to the antenna array, subarrays and power coefficients, as illustrated in FIG. 1, and can be applied to any system for which the various embodiments presented herein are applicable.

As previously mentioned, an irregular subarray approach is undertaken, whereby different power coefficients, in conjunction with different sized subarrays (e.g., any of $A_1$-$A_4$, $B_1$-$B_8$, $C_1$-$C_4$, or $D_1$-$D_4$) are utilized to approach a unity power coefficient. However, advantage is taken of T-splitter (also known as a T-junction divider, T-junction splitter) and feed line losses across the antenna array to facilitate aperture taper (e.g., power coefficient tapering across the antenna array). For example, subarrays $B_1$-$B_8$ comprise two radiators, where each radiator has a power coefficient of 0.4732, with a power coefficient sum of 0.4732+0.4732=0.9464, rather than unity. To facilitate operation of subarrays $B_1$-$B_8$, and the respective pair of radiators included in each subarray $B_1$-$B_8$, a T-splitter is incorporated into the feed line to facilitate equal distribution of power to each of the radiators included in each subarray $B_1$-$B_8$, as further described herein.

Further, feed line sections can be included into the respective portions of the antenna array, and subarrays included in the antenna array, as further described herein. A combination of line loss in the respective feed line sections along with losses at each respective T-splitter can cause a sum of power coefficients to be less than unity. For example, for subarrays $B_1$-$B_8$ the sum of the pair of power coefficients is 0.9464, rather than unity. Hence, as illustrated in FIG. 1, radiators comprising subarrays $A_1$-$A_4$ are operating with a power coefficient of 1.0000. However, the subarrays comprising $C_1$-$C_4$ have respective power coefficients 0.4573+0.3201+0.1372=0.9146. Further, the subarrays comprising $D_1$-$D_4$ have a variety of power coefficients 0.2725+0.2725+0.033+0.033+0.033+0.033+0.0743+0.0743=0.8256. Furthermore, the subarrays comprising $E_1$-$E_4$ have a variety of power coefficients 0.2777+0.1389+0.1389+0.0980+0.0490+0.0490+0.0327+0.0163+0.0163=0.8168. Hence, from a power coefficient of 1.0000 being utilized at the central subarrays $A_1$-$A_4$, with the arrangement of the various subarrays and radiators included in the various subarrays, a tapered distribution of power coefficients can be established with a maximum power coefficient of 1.0000 being utilized at the central subarrays $A_1$-$A_4$, tapering to lower power coefficient values (e.g., 0.0163, 0.0327, 0.0330, etc.) at the radiator elements located on the periphery of the antenna array 100.

With further reference to FIG. 1, twenty radiating elements have been omitted from antenna array 100, as denoted by the zeros on the periphery of antenna array 100. The four radiators missing at each corner, respectively marked $H_1$-$H_4$, have a minimal effect upon the overall pattern of the aperture taper, with the aperture taper requiring low radio-frequency (RF) power. Further, two radiators can be negated from the right and left sides of the antenna array, as again these radiators will utilize low RF power and hence their effect of the overall pattern of the aperture taper is also minimal. Removal of radiators which will have minimal effect on an overall aperture taper pattern can be advantageous in freeing up real-estate for other components associated with operation of the antenna array.

As shown in FIG. 1, a number of adjacent radiators have the same RF power values. Such an arrangement enables a plurality of 50/50 T-splitters to be used across the feed network of the antenna array 100. It is to be appreciated that that the T-splitters have no magnitude or phase differences between their two insertion paths, which further minimizes the generation and/or magnitude of a sidelobe(s) as any error; particularly, phase error between a first feed line and a second feed line is prevented.

Figure 2:
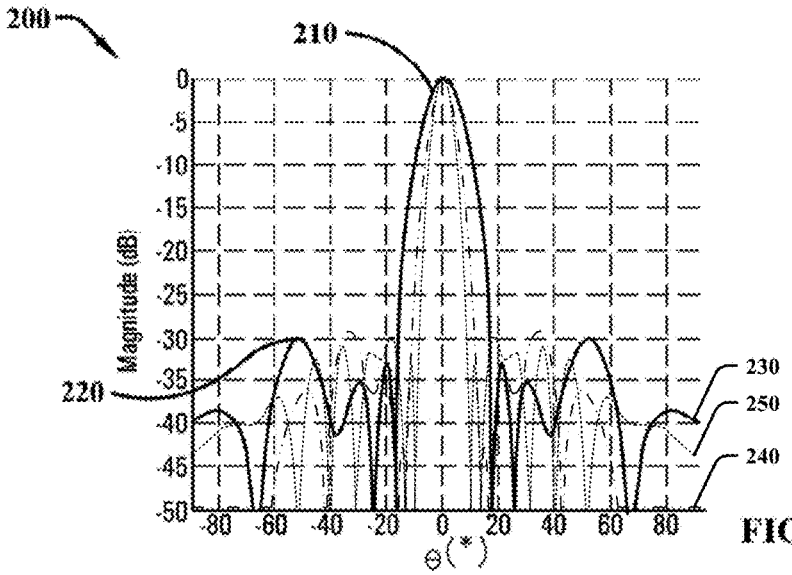
FIG. 2 is an $E_\theta$ Elevation Pattern.
Figure 17:
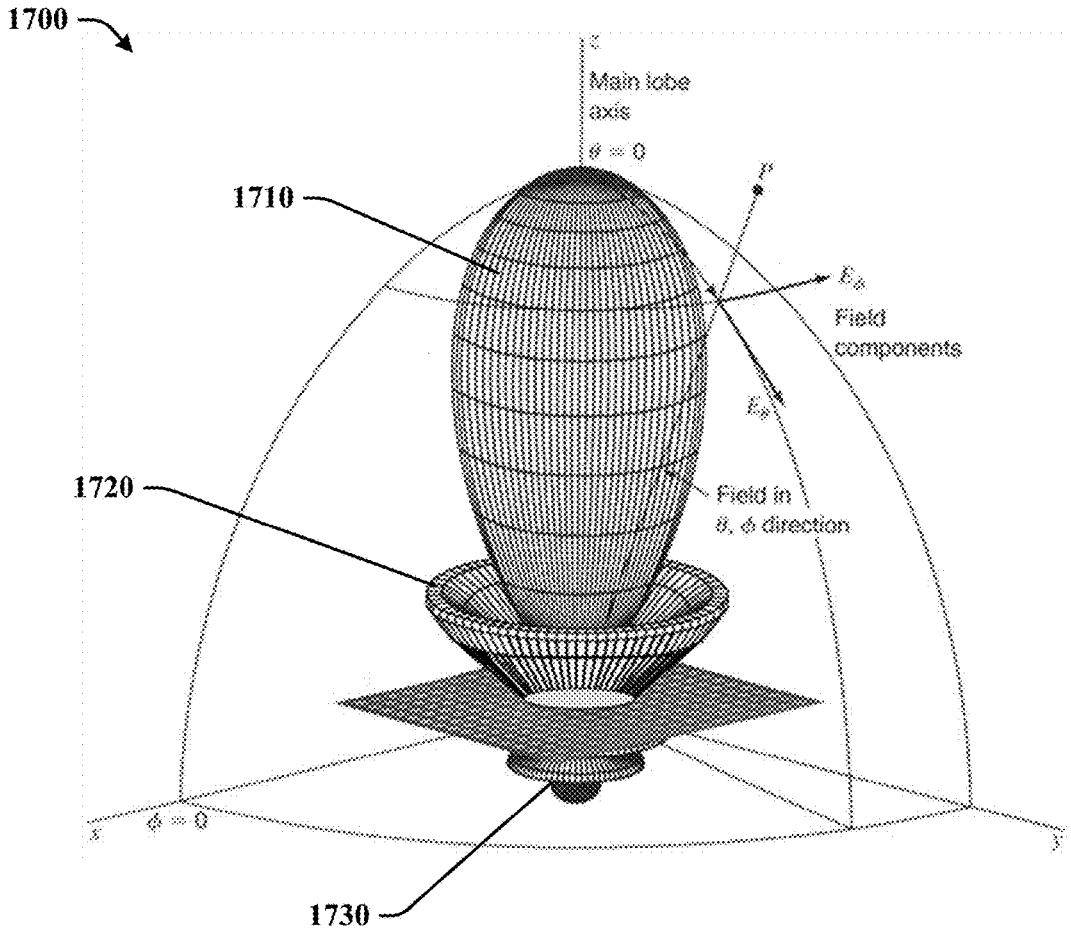
FIG. 17 is a graphical representation of mainlobe and SSL formation.

FIG. 2 illustrates an $E_\theta$ Elevation Pattern for the antenna array illustrated in FIG. 1 utilizing a tapered power coefficient approach. FIG. 2 can be read in conjunction with FIG. 17, where the magnitude (dB) for three values for $E_\theta$ ($\varphi$=0°—unbroken line 230), $E_\theta$ (p$\varphi$=45°—double dotted line 240), and $E_\theta$ ($\varphi$=90°—hashed line 250) are plotted with respect to $\theta$. As shown in FIG. 2, with the mainlobe 210 having a base value set to zero, the highest maximum determined sidelobe 220 magnitude is −30 dB, as determined at ±18 $\theta$, ±35 $\theta$, and ±50 $\theta$. Hence, a sidelobe 220 with a magnitude of −30 dB equates to a sidelobe having a sidelobe level (SSL) of approximately 0.1% of the transmit/receive power of the mainlobe 210. It is to be noted that the various embodiments presented herein follow the mathematical nomenclature of −10 dB relates to 10% of a baseline magnitude, −20 dB relates to 1% of a baseline magnitude and −30 dB relates to 0.1% of a baseline magnitude.

Array Topology and Layout

Figure 3:
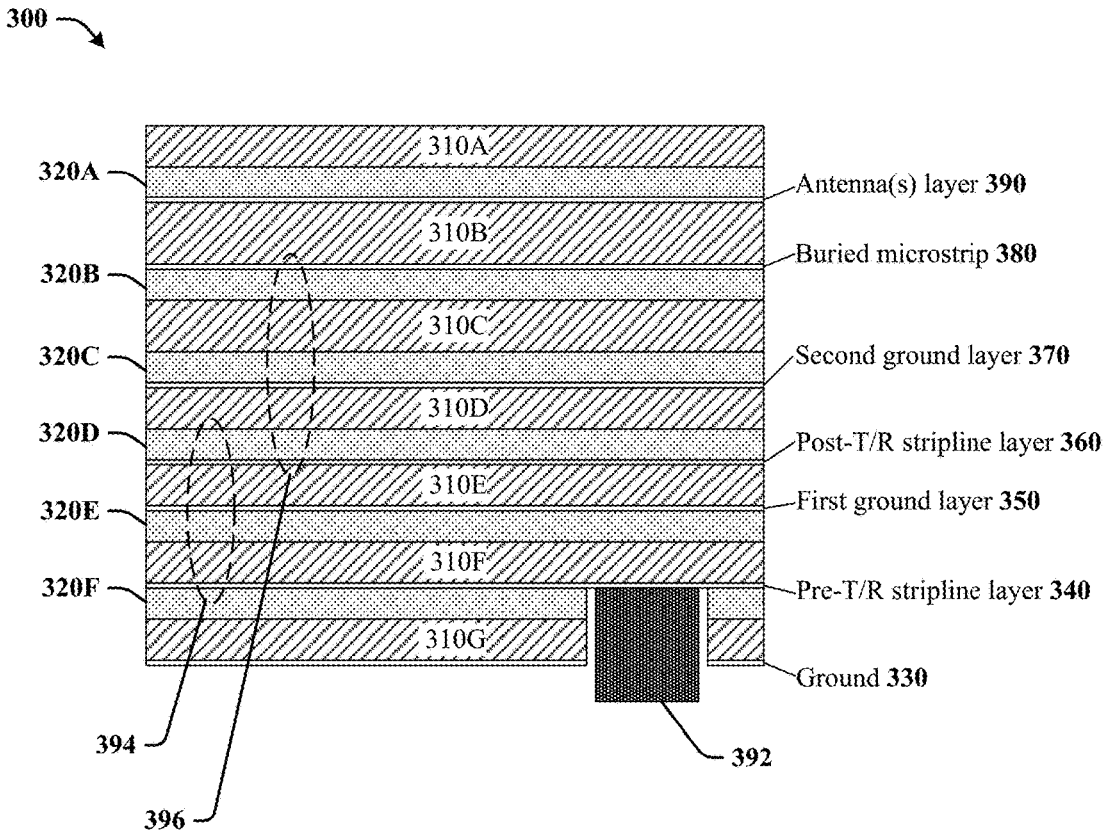
FIG. 3 is a block diagram illustrating an exemplary antenna array topology for mitigation/reduction of SSL during operation of an antenna array.

FIG. 3 illustrates an array topology 300 according to an exemplary embodiment. A structure is formed comprising a plurality of layers 310A-310G (e.g., glass microfiber reinforced polytetrafluoroethylene (PTFE) composite such as DUROID 5880) bonded together with layers of bonding film 320A-320F (e.g., a low temperature bonding film such as ARLON bonding film). In an exemplary embodiment, layers 310A-310G can have a dielectric constant $\varepsilon_r$ of 2.2, while the bonding films 320A-320F can have a dielectric constant $\varepsilon_r$ of 2.35.

As illustrated in FIG. 3, the plurality of layers 310A-310G further comprise a number of layers (e.g., metalized layers) to facilitate operation of the antenna array, as explained further herein. A transmit/receive (T/R) module 392 can be associated with the array 300, where operation of a T/R module is further explained herein. A ground layer 330 is formed on layer 310A, which can provide grounding, as necessary, for one or more layers or components comprising array 300. In an embodiment, as shown by electrical coupling 394, a pre-T/R stripline layer 340 can be electrically coupled with a post-T/R stripline layer 360, via ground layer 350. Further, as shown by electrical coupling 396, the post-T/R stripline layer 340 can be electrically coupled with a buried microstrip layer 380, via ground layer 370. The buried microstrip layer 380 can, in an embodiment, be utilized to direct energy to/from an antenna 390 (e.g., a U-slot patch antenna). Antenna 390 can comprise a U-slot patch antenna which can exhibit dual-pole style resonance enabling antenna 390 to transmit electro-magnetic energy through the array 300 in free space over a large bandwidth (e.g., across $K_u$ band frequencies, approx. 12-18.2 GHz, approx. 15.2-18.2 GHz, etc).

Utilization of a material having dielectric properties at high radio frequencies (e.g., in the $K_u$ band, approx. 12-18 GHz), such as PTFE, enables electrical coupling (e.g., electrical couplings 394 and 396) between the various component layers (e.g., layers 330-390) to occur without the need for vias or other interconnects to be formed between the respective layers. Negating the need for vias or other interconnects to be formed in an antenna array enables an antenna array (e.g., an array 300) to be manufactured with a relatively simple manufacturing operation, e.g., the number of manufacturing steps required to produce an array 330 is reduced in comparison with an array utilizing vias. Further, owing to the reduced complexity of the array 330, the operational reliability of array 330 is improved over a conventional array comprising vias, which can be prone to circuit breakage, circuit shorting, etc., owing to, for example, differences in thermal expansion of material comprising a via compared with material comprising an adjacent/supporting structure.

In an exemplary embodiment, bonding layers 320A-320F can have a thickness of approximately 1.5 mil, while layer 310A can have a thickness of approximately 10 mil., layer 310B can have a thickness of approximately 31 mil., layer 310C can have a thickness of approximately 20 mil., layer 310D can have a thickness of approximately 10 mil., layer 310E can have a thickness of approximately 10 mil., layer 310F can have a thickness of approximately 10 mil., and layer 310G can have a thickness of approximately 10 mil. The thickness of the array (e.g., layers 310A-310G and layers 320A-320F) can be approximately 110 mil. (approx. 4.33 mm). In an exemplary embodiment, layer 310A can act as a superstrate for environmental protection of the underlying layers.

RF energy can be inputted into the array 300 via the pre-T/R stripline layer 340, whereby the RF power can further proceed to the post-T/R stripline layer 360 by coupling up through a shared ground layer 350 (e.g., comprising a H-shaped slot) located in between the two stripline layers 340 and 360. The post-T/R stripline layer 360 essentially acts as an irregular subarray feed that directs RF energy to various radiating elements (e.g., antennas formed in antenna layer 390). Each of these radiator elements includes a stripline-to-slotline-to-buried-microstrip transition. This transition is necessary in isolating an antenna(s) (e.g., the U-slot patch antenna) from the stripline feed networks for SLL control. The buried microstrip layer 380 directs the power under an antenna 390, where it couples to the antenna 390 for radiation of a desired electromagnetic energy into free space.

While only exemplary electrical couplings 394 and 396 are shown, it is to be appreciated that the various embodiments presented herein are not so limited and any suitable coupling can be established to facilitate operation of the antenna array and the various embodiments presented herein. It is further to be appreciated that while the various embodiments presented herein relate to a transmission line system such as a stripline, the various embodiments are not so limited and other transmission line systems can be equally applied, such as, for example, microstrip, coaxial cable, etc.

Figure 4:
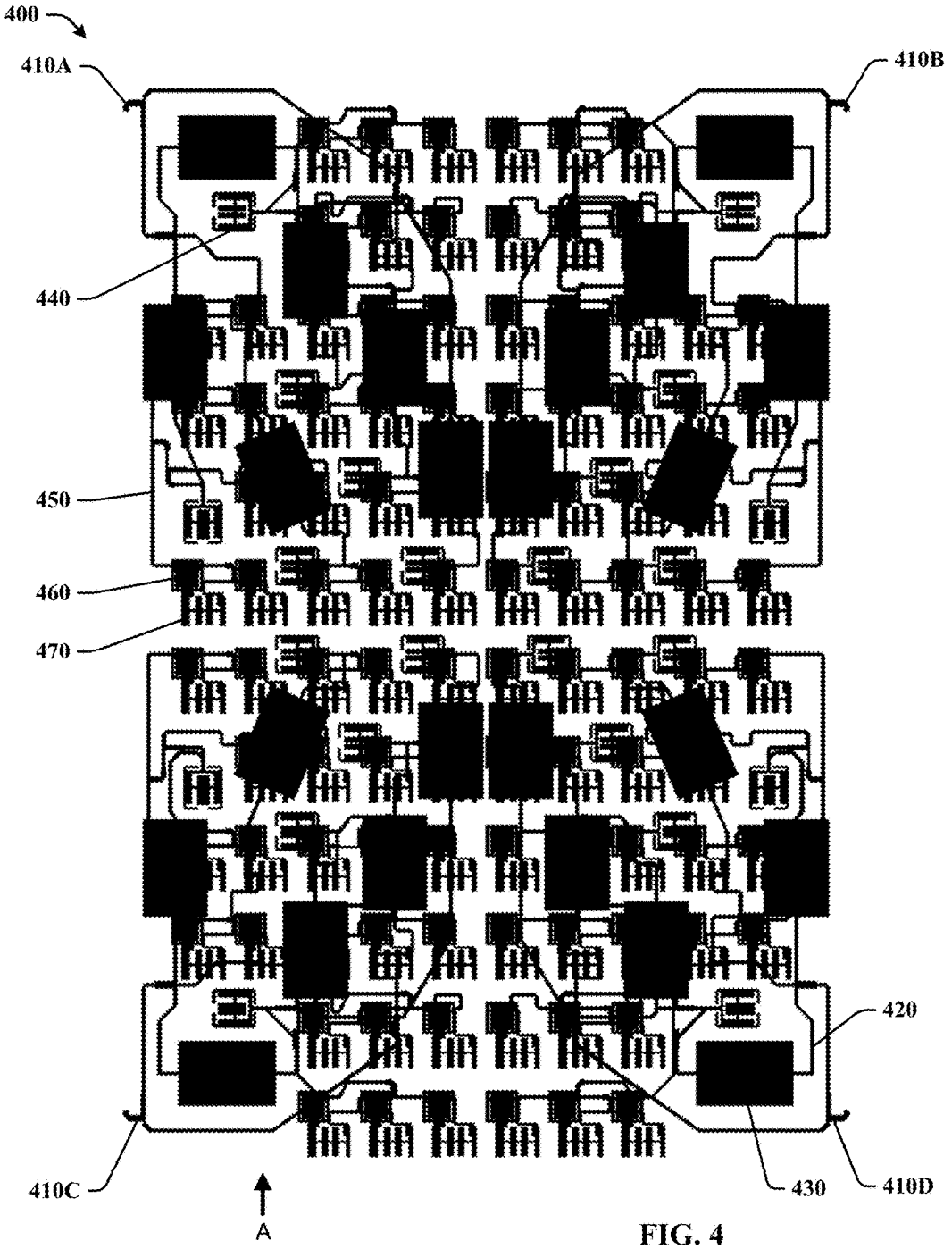
FIG. 4 is a block diagram illustrating an exemplary antenna array for mitigation/reduction of SSL during operation of an antenna array.

FIG. 4 illustrates an antenna array 400 according to an exemplary embodiment. FIG. 4 illustrates the various components which can be included in an antenna array 400, however, owing to limitations of reproduction an overview will be provided with reference to FIG. 4, while the various components and structures will be described further in FIGS. 5-9, 11, and 13. At an overview level, array 400 can comprise four input ports 410A-410D, which in this embodiment, are located in the corners of array 400. In an exemplary embodiment, the four input ports 410A-410D can be combined to form a single input port to produce a sum pattern. In a further exemplary embodiment, the four input ports 410A-410D can be combined utilizing a single 0180° comparator for single-axis monopulse functionality. In another embodiment, the four ports 410A-410D can be combined with four 0°/180° comparators for dual-axis monopulse capability.

In the illustrated embodiment, each of the four input ports 410A-410D are connected by an electrical path 420 to a T/R module 430. As explained further herein, the exemplary embodiment depicted in FIG. 4, includes twenty four T/R modules 430, whereby the T/R modules 430 are further connected to a plurality of stripline-to-stripline interconnects 440. The stripline-to-stripline interconnects 440 facilitate 'stripline-to-stripline transitions', with a stripline-to-stripline transition facilitating power conveyance between a first stripline layer (e.g., pre-T/R stripline layer 340) and a second stripline layer (e.g., post-T/R stripline layer 360) via a first shared ground 350 (e.g., a first H-shaped ground slot) located in the shared ground between the first stripline layer and the second stripline layer. In the embodiment illustrated in FIG. 4, twenty four stripline-to-stripline interconnects 440 are included in array 400, with each stripline-to-stripline interconnect 440 being located proximate to a T/R module 430.

Figure 9:
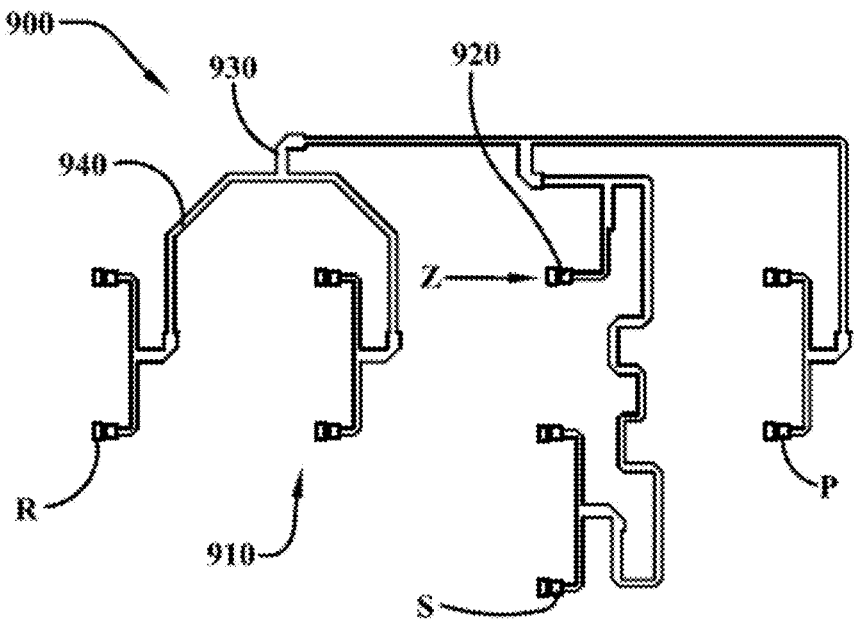
FIG. 9 is a block diagram illustrating an exemplary subarray for utilization in mitigation/reduction of SSL during operation of an antenna array.
Figure 11:
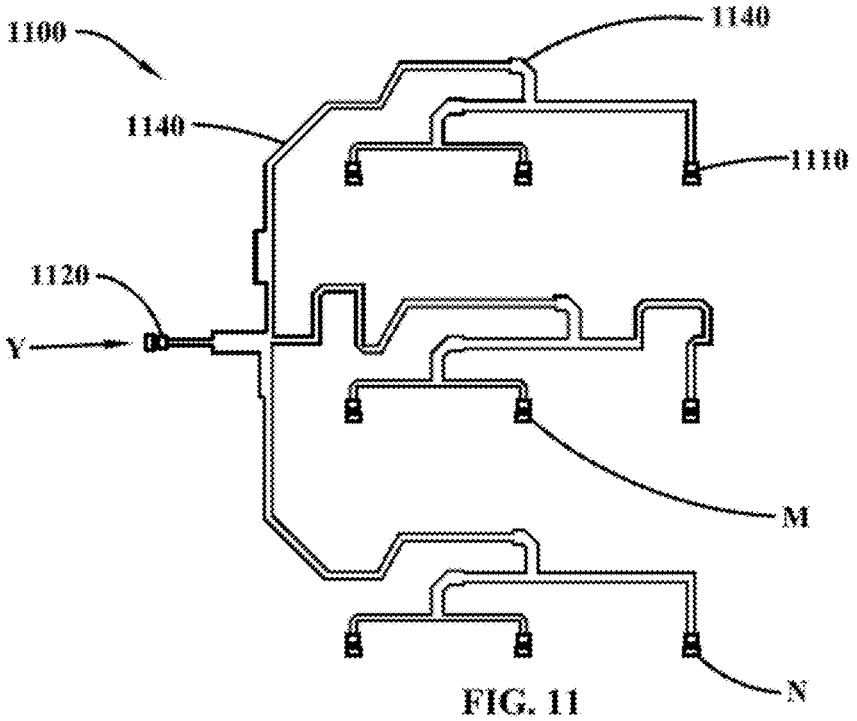
FIG. 11 is a block diagram illustrating an exemplary subarray for utilization in mitigation/reduction of SSL during operation of an antenna array.

Power is further conveyed between a stripline-to-stripline interconnect 440 and a radiator element 470 via an electrical path 450 (e.g., an electrical feeding structure, an electrical circuit, etc.) and a second ground 370 (e.g., (e.g., a second H-shaped ground slot) associated with the radiator element 470. Electrical coupling of the port-T/R stripline layer 360 with the buried microstrip layer 380 (e.g., coupling 396 across ground layer 370) facilitates directing energy beneath an antenna(s) 390. As explained further herein (ref. FIGS. 9 and 11), a combination of T-splitter placement and utilizing electrical paths 450 of differing lengths is utilized to facilitate aperture taper across antenna array 400.

Figure 5:
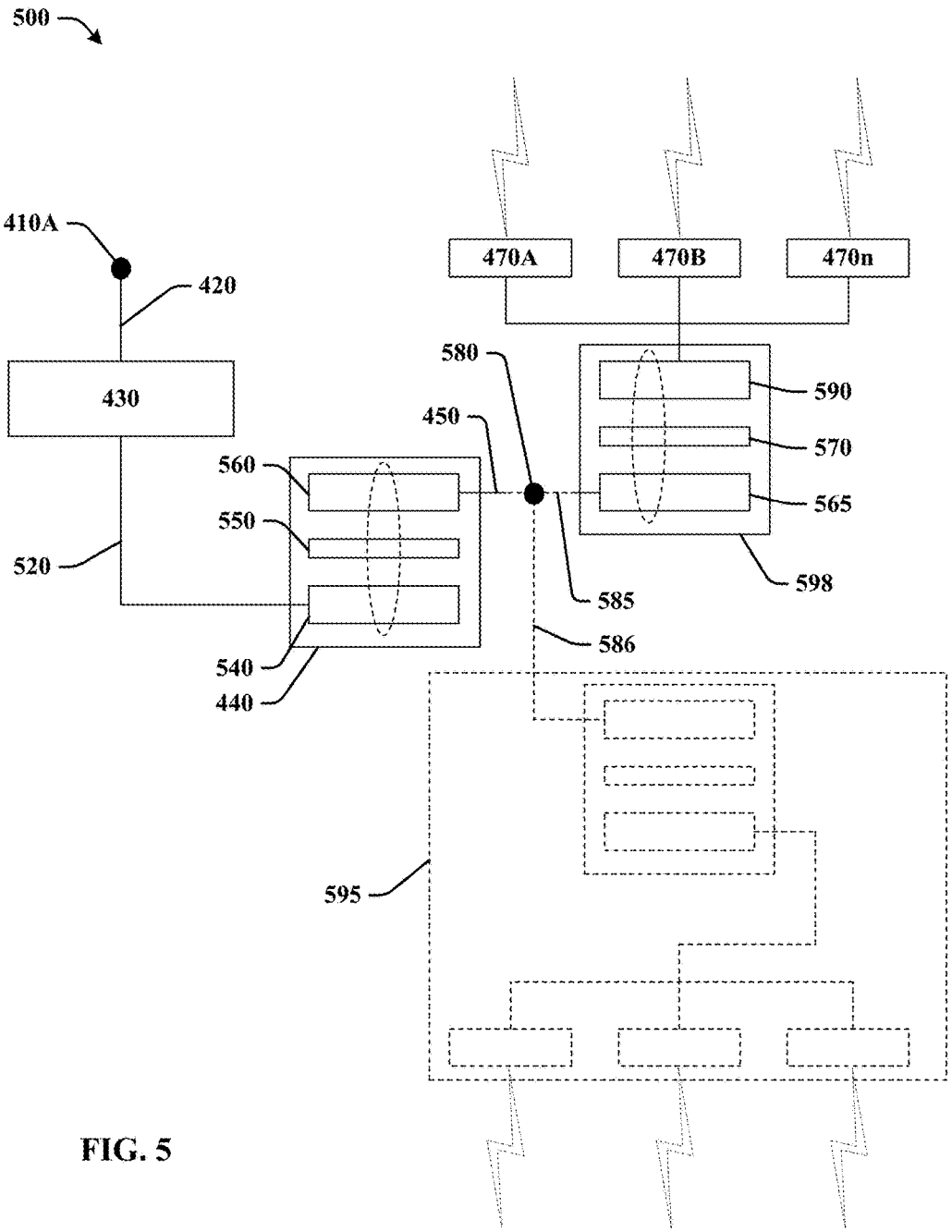
FIG. 5 is a block diagram illustrating an exemplary antenna array for mitigation/reduction of SSL during operation of an antenna array.

FIG. 5 illustrates a schematic 500 of an antenna array system according to an embodiment. FIG. 5 can be read in conjunction with FIGS. 3 and 4, and presents a stylized representation in direction A of FIG. 4 to provide an understanding of the layering of the various components comprising an antenna array. Power can be supplied via input port 410A, which is conveyed to T/R module 430 via electrical path 420. In an embodiment, during a transmit phase of operation of an antenna array (e.g., array 400), each input port can distribute an equal amount of power to each T/R module 430 included in the antenna array (e.g., in the exemplary embodiment, each of the twenty four T/R modules 430 comprising antenna array 400) along with any necessary difference in insertion phase. Each of the T/R modules 430 included in an antenna array can be, in an embodiment, configured to operate in an identical manner (e.g., all biased equally) and further, the power level leaving each T/R modules 430 can also be identical/equal. Hence, the power level is configured to be identical for all electrical paths 420 and 520 which form part of an antenna array. Power on electrical path 520 is fed into stripline-to-stripline interconnect 440. Stripline interconnect 400 comprises a pre-T/R stripline layer 540 (e.g., a pre-T/R stripline layer 340) which is electrically coupled (e.g., via electrical coupling 394) to a post-T/R stripline layer 560 across common ground layer 550. Energy conveyed across the common ground layer 550 to the post-T/R stripline layer 560 is conveyed via electrical path 450 to one or more T-splitters 580. At each T-splitter (e.g., at each T-splitter 580) the electrical energy is split 50/50 equally across the T-splitter, hence 50% of the electrical energy arriving at T-splitter 580 along electrical path 450 is directed towards a radiator element 470A-470*n*, while the remaining 50% of the electrical energy arriving at T-splitter 580 along electrical path 450 is directed along electrical path 586 and associated components 595.

Electrical energy on electrical path 585 is directed towards a radiator 598 comprising a second a post-T/R stripline layer 565 which is proximity coupled (e.g., via electrical coupling 396) to a buried microstrip layer 590 (e.g., buried microstrip layer 380) across ground layer 570 (e.g., comprising a H-shaped slot). The buried microstrip layer 590 directs energy beneath the antenna(s) 470A-470B.

Figure 6:
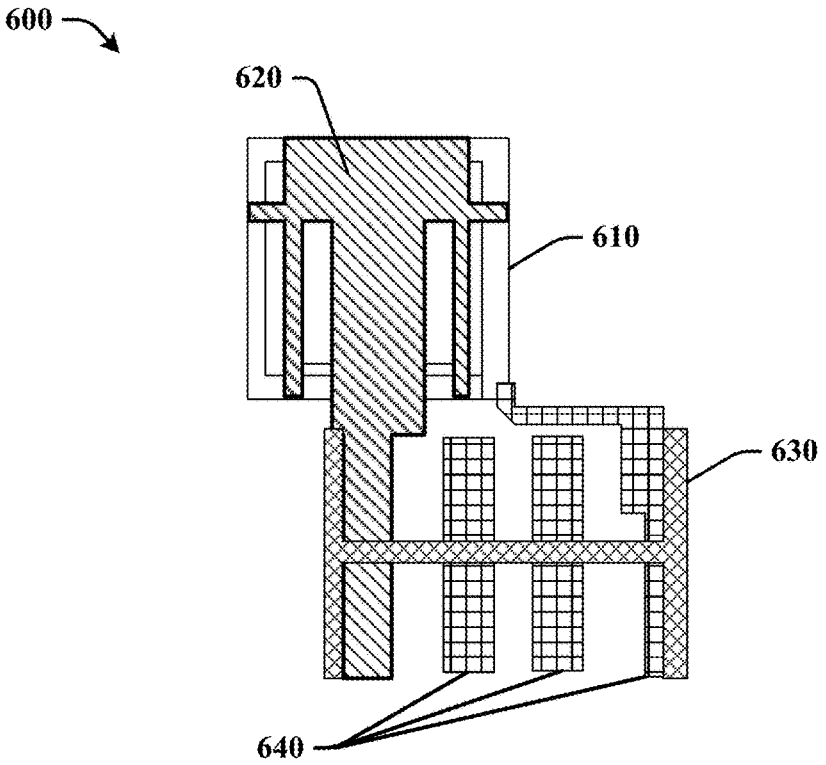
FIG. 6 is a block diagram illustrating an exemplary radiator cell for utilization in mitigation/reduction of SSL during operation of an antenna array.

FIG. 6 illustrates a radiator cell 600 according to an embodiment. Radiator cell 600 comprises an antenna 610 (e.g., a U-slot patch antenna), a buried microstrip 620, a H-shaped slotline 630 and stripline components 640. As power is applied to the stripline components 640, the power is conveyed to the buried microstrip 620 via the H-shaped slotline 630 and further on to antenna 610 which converts the received power for transmission as electromagnetic energy. Radiator cells 600 are located throughout an antenna array as shown in FIG. 4, with a plurality of H-shaped slotline components 470 and antennas 460 as depicted in FIG. 4.

Figure 7:
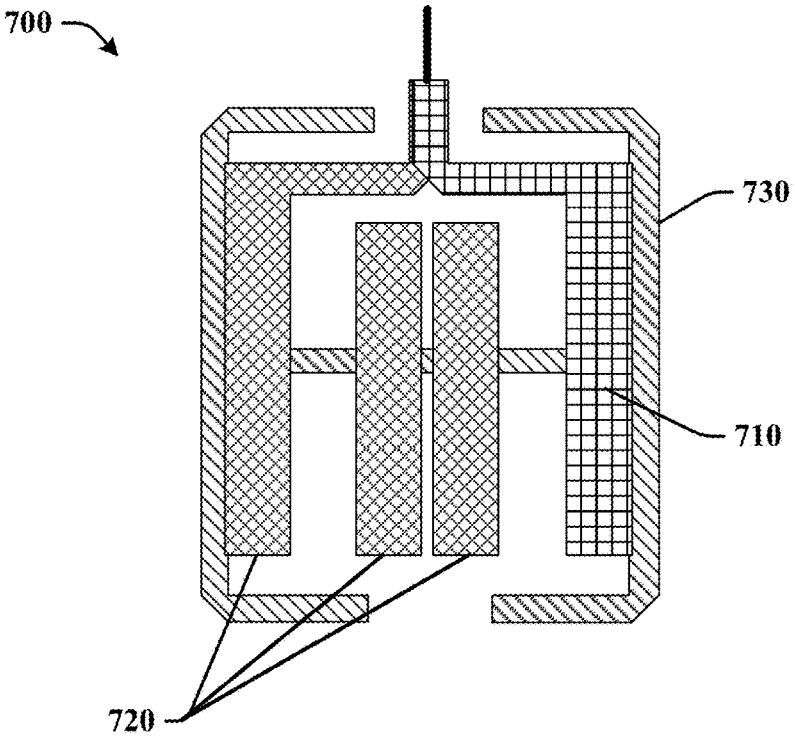
FIG. 7 is a block diagram illustrating an exemplary stripline-to-stripline transition component for utilization in mitigation/reduction of SSL during operation of an antenna array.

FIG. 7 illustrates a stripline-to-stripline transition component 700, according to an exemplary embodiment. Stripline-to-stripline transition component 700 comprises a top stripline component 710, bottom stripline components 720, and an intermittent slotline 730. As power is applied to the bottom stripline components 720, electrical coupling of the bottom stripline components 720 with the top stripline component 710 facilitates transmission of power to the top stripline component 710.

As previously mentioned, aperture taper across an antenna array is facilitated, according to an exemplary embodiment, by placement of one or more T-splitters in a post-T/R feed network (e.g., T-splitter 580 in electrical paths 450 and 585) in conjunction with design of the post-T/R feed network (e.g., electrical paths 450 and 585) with regard to electrical path length of the various electrical paths comprising the post-T/R feed network. While two or more electrical paths comprising a post-T/R feed network may be of the same path length electrically, an antenna array comprising a number of electrical path lengths, and associated T-splitters, can be designed, whereby the irregular path length and T-splitter placement(s) engender a plurality of irregular-subarray feed networks.

The post-T/R feed network (also termed an irregular-subarray feed network) forms the electrical circuits between a stripline-to-stripline interconnect (e.g., stripline-to-stripline interconnect 440) and a radiator element 470, e.g., electrical paths 450 and 585 (and also electrical path 586). In an embodiment, the post-T/R feed networks are designed to yield flat insertion loss responses over all frequencies of operation of an antenna array and, further, have a linear phase profile over the operating frequency range(s). While not fully depicted in FIG. 4, the exemplary embodiment of antenna array 400, the antenna array 400 is divided into a number of subarrays which include either one, two, three, eight or nine radiating elements, as depicted by the divisional representation shown in FIG. 1.

Figure 8:
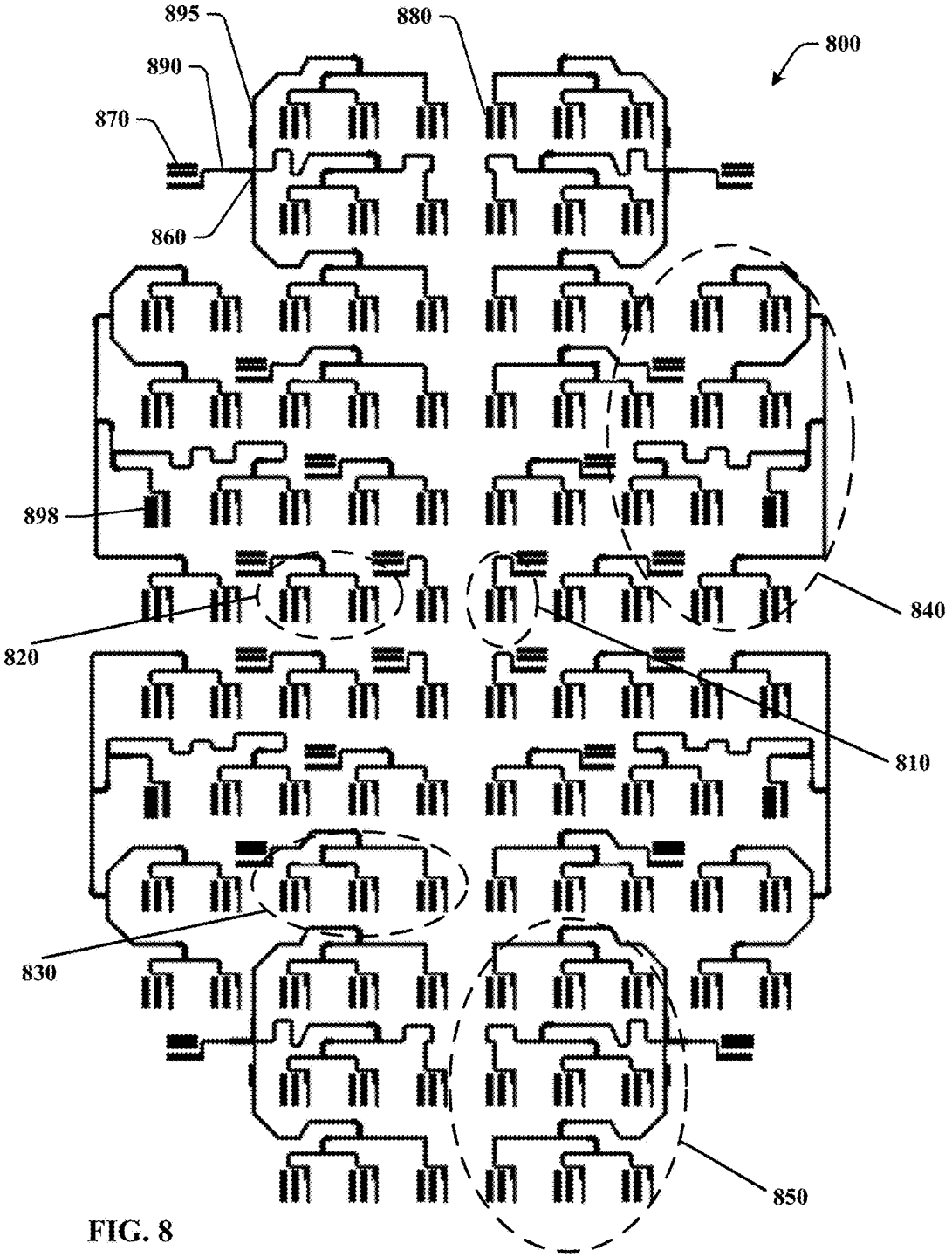
FIG. 8 is a block diagram illustrating an exemplary post transmit/receive (T/R) feed network for utilization in mitigation/reduction of SSL during operation of an antenna array.

FIG. 8 illustrates a schematic 800 of a post-T/R feed network, in accordance with an embodiment. Schematic 800 is a representation of the port-T/R feed network which forms a part of the antenna array 400 illustrated in FIG. 4, and further, illustrates the post-T/R feed network required to facilitate formation of the various subarrays forming an antenna array having the power coefficients as depicted in FIG. 1. A plurality of stripline-to-stripline transition components 870 (e.g., comparable to stripline-to-stripline transition component 700) are located in conjunction with a plurality of radiator cells 880 (e.g., comparable to radiator cell 600). Each stripline-to-stripline component 870 is connected to one or more radiator cells 880 by at least one electrical path 890, where a number of electrical paths are split by placement of a T-splitter 860 to form a first portion of an electrical path 890 separated from a second portion of an electrical path 895 by a T-splitter 860. T-splitters 860 (e.g., 50/50 T-splitters) into an antenna array can be utilized in accord with the various embodiments presented herein owing to T-splitters 860 having no insertion phase of magnitude errors when the pair of outgoing transmission paths from a T-splitter 860 are compared over a wide frequency range(s)/bandwidth. Hence, as shown in FIG. 8, a number of T-splitters 860 are utilized throughout an antenna array in accordance with an embodiment, for example, 78% of all the splits in the post-T/R feed networks depicted in FIG. 8 comprise T-splitters 860. Implementation of such a large number of T-splitters 860 can mitigate the cumulative effects of phase error across an antenna array which does not utilize T-splitters 860. Phase errors can result in higher SLLs, and hence by minimizing phase error the magnitude, if any, of SLLs arising from phase error can accordingly be minimized.

As previously mentioned, an antenna array (e.g., antenna array 400) can be divided into a number of subarrays, which include either one, two, three, eight or nine radiating elements. As shown in FIG. 8, a single radiator cell 880 can be directly associated with a stripline-to-stripline component 870, as depicted with subarray 810. With reference to FIG. 1, with subarray 810 only comprising a single radiator cell 880, subarray 810 can be considered to be equivalent to any of subarrays Subarray 820 comprises a pair of radiator cells 880, and again with reference to FIG. 1, subarray 820 can be considered to be equivalent to any of subarrays $B_1$-$B_8$. Subarray 830 comprises three radiator cells 880, and with further reference to FIG. 1, subarray 830 can be considered to be equivalent to any of subarrays $C_1$-$C_4$. Subarray 840 comprises eight radiator cells 880, and again with reference to FIG. 1, subarray 840 can be considered to be equivalent to any of subarrays $D_1$-$D_4$. Further, subarray 850 comprises nine radiator cells 880, and with reference to FIG. 1, subarray 850 can be considered to be equivalent to any of subarrays $E_1$-$E_4$. Subarrays 810, 820 and 830, respectively comprising one, two and three radiator cells 880, can be relatively easy to design, e.g., utilizing a reactive-matching technique. Design of subarrays 840 and 850, owing to the number of T-splitters 860 and radiator cells 880 comprising the respective subarrays 840 and 850 can require complicated design of the subarrays 840 and 850, as further explained herein.

FIG. 9 illustrates a subarray 900 as utilized in a subarray operated in conjunction with eight radiator cells, in accordance with an exemplary embodiment. Subarray 900 can be considered to be comparable to the subarray 840, as depicted in FIG. 8. Subarray 900 comprises eight connection points 910 to electrically connect eight radiator cells (e.g., a radiator cell 880 is connected to each connection point 910) which are connected via electrical path 940 to a connector 920, to which can be further connected a stripline-to-stripline transition component 870. In a transmission operation, electrical energy can be supplied to the subarray 900 from a stripline-to-stripline transition component 870, whereby the electrical energy is distributed across subarray 900 via electrical path 940 and a plurality of T-splitters 930. As previously mentioned, a unity of power can be provided to the subarray 900, where based upon the respective electrical path length (e.g., distance from Z to connector P versus the distance from Z to connector R) and the number of T-splitters 930 encountered during conveyance of the electrical energy across a respective path, a power coefficient at each connector 920 (e.g., a power coefficient applied to a radiator cell 880 located at each connector 920) can be controlled to facilitate a desired aperture taper. For example, with reference to FIG. 1, owing to the proximity of connector S to input Z (e.g., only two T-splitters 930 are incorporated into the electrical path) a higher power coefficient at connector S (and accordingly an associated radiator cell 880) can be generated compared to the power coefficient at connector R (and accordingly an associated radiator cell 880) as four T-splitters 930 are incorporated into the electrical path servicing connector R. Further, with only three T-splitters 930 being incorporated into the electrical path servicing connector P, it is probable that a power coefficient measured at connector P will have a value between the power coefficient measured at connector S and the power coefficient measured at connector R. Subarray $D_1$ illustrated in FIG. 1 has a power coefficient of 0.2725 (e.g., as determined at connector S), a power coefficient of 0.0330 (as determined at connector P) and a power coefficient of 0.0743 (as determined at connector R).

Figure 10:
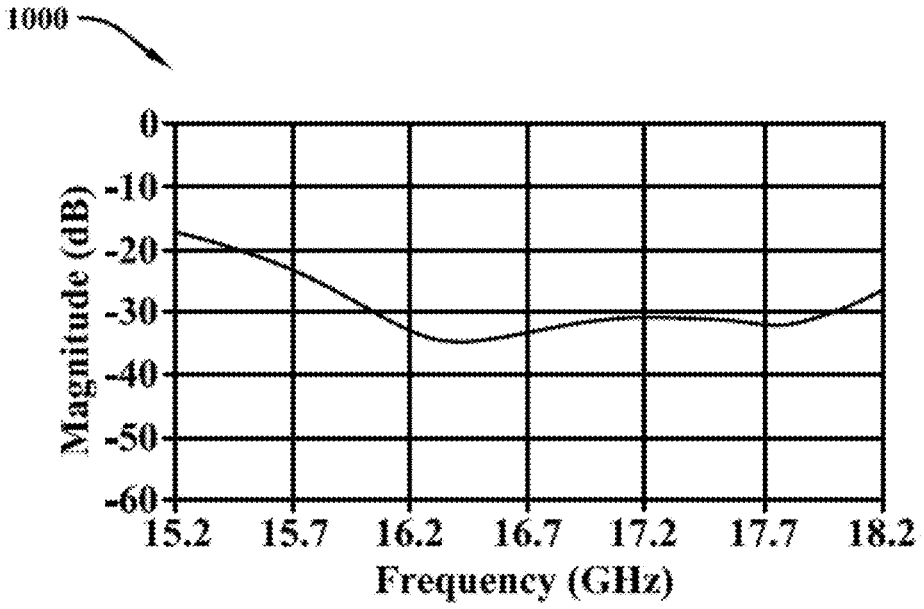
FIG. 10 is a graphical representation illustrating associated return loss for an a subarray for utilization in mitigation/reduction of SSL during operation of an antenna array.

FIG. 10 is a graphical representation 1000 of a determined associated return loss in a simulated operation of a subarray of an antenna array, according to an embodiment. An associated return loss for an eight connector subarray, comparable to subarray 900, as depicted in FIG. 9, is presented across a frequency range of 15.2-18.2 GHz. As shown in FIG. 10, an input match of approx. −30 dB is calculated for much of the frequency range (e.g., approx. 16-18 GHz), with the determined insertion losses being approx. flat across the entirety of the 3 GHz frequency band shown.

FIG. 11 illustrates a subarray 1100 as utilized in a subarray operated in conjunction with nine radiator cells, in accordance with an embodiment. Subarray 1100 can be considered to be comparable to the subarray 850, as depicted in FIG. 8. Subarray 1100 comprises nine connection points 1110 to electrically connect nine radiator cells (e.g., a radiator cell 880 is connected to each connection point 1110) which are connected via electrical path 1140 to a connector 1120, to which can be further connected a stripline-to-stripline transition component 870. In a transmission operation, electrical energy can be supplied to the subarray 1100 from a stripline-to-stripline transition component 870, whereby the electrical energy is distributed across subarray 1100 via electrical path 1140 and a plurality of T-splitters 1130. As previously mentioned, a unity of power can be provided to the subarray 1100, where based upon the respective electrical path length (e.g., distance from Y to connector N versus the distance from Y to connector O) and the number of T-splitters 1130 encountered during conveyance of the electrical energy across a respective path, a power coefficient at each connector 1120 (e.g., a power coefficient applied to a radiator cell 880 located at each connector 1120) can be controlled to facilitate a desired aperture taper. For example, with reference to FIG. 1, owing to the proximity of connector M to input Y (e.g., only three T-splitters 1130 are incorporated into the electrical path) a higher power coefficient at connector M (and accordingly an associated radiator cell 880) can be generated compared to the power coefficient at connector N (and accordingly an associated radiator cell 880) as three T-splitters 930 are incorporated into the electrical path servicing connector N, with the electrical path length to connector N being longer than the electrical path length to connector M. Hence, it is probable that a power coefficient measured at connector M will have a higher value than the power coefficient measured at connector N. Subarray $E_1$ illustrated in FIG. 1 has a power coefficient of 0.2777 (e.g., which may be determined at connector M) while a lower power coefficient of 0.1389 may be determined at connector N.

Figure 12:
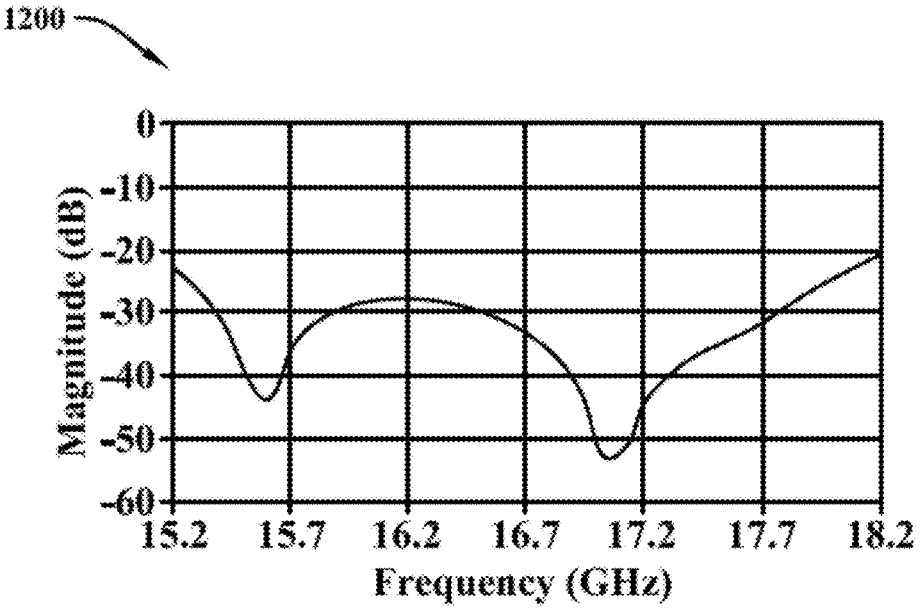
FIG. 12 is a graphical representation illustrating associated return loss for an exemplary subarray for utilization in mitigation/reduction of SSL during operation of an antenna array.

FIG. 12 is a graphical representation 1200 of a determined associated return loss in a simulated operation of a subarray of an antenna array, according to an embodiment. An associated return loss for a nine connector subarray, comparable to subarray 1100, as depicted in FIG. 11, is presented across a frequency range of 15.2-18.2 GHz. As shown in FIG. 12, an input match of approx. −30 to −53 dB is calculated for much of the frequency range (e.g., approx. 15.4-17.7 GHz).

As previously mentioned, utilizing one or more stripline-to-stripline transition components (e.g., stripline-to-stripline transition components 870), in conjunction with one or more T-splitters (e.g., any of T-splitters 860), in a post-T/R feed network (e.g., any of subarrays 810, 820, 830, 840 or 850) and electrical path length can be utilized to facilitate design of a subarray having different phase lengths between their respective input ports (e.g., connector 920 of subarray 900 or connector 1120 of subarray 1100) and their respective output ports (e.g., any of connectors 910, P, R or S of subarray 900 or any of connectors 1110, M or N of subarray 1100). Hence, a phase difference can be applied for each stripline-to-stripline transition to facilitate respective powers to arrive at the various radiator cells (e.g., any of radiator cells 600) at exactly the same time. Hence, with reference to FIG. 1, in the exemplary embodiment presented, the shortest subarray feed networks are associated with the four central subarrays $A_1$-$A_4$. However, in the exemplary embodiment, the longest electrical path lengths are encountered in the subarray feed networks associated with the eight radiator subarrays, subarrays $D_1$-$D_4$. Accordingly, the phase for the subarrays $D_1$-$D_4$ can be configured to 1P0° and/or 1P1° where no additional phase delay is configured. In an embodiment, with an operating frequency of approx. 16.7 GHz, an additional phase delay of 1508° is required at subarrays $A_1$-$A_4$, to facilitate power reaching the radiator cells associated with subarrays $A_1$-$A_4$ at the same time, i.e., concurrently, as the power reaches the radiator cells associated with subarrays $D_1$-$D_4$.

Figure 13:
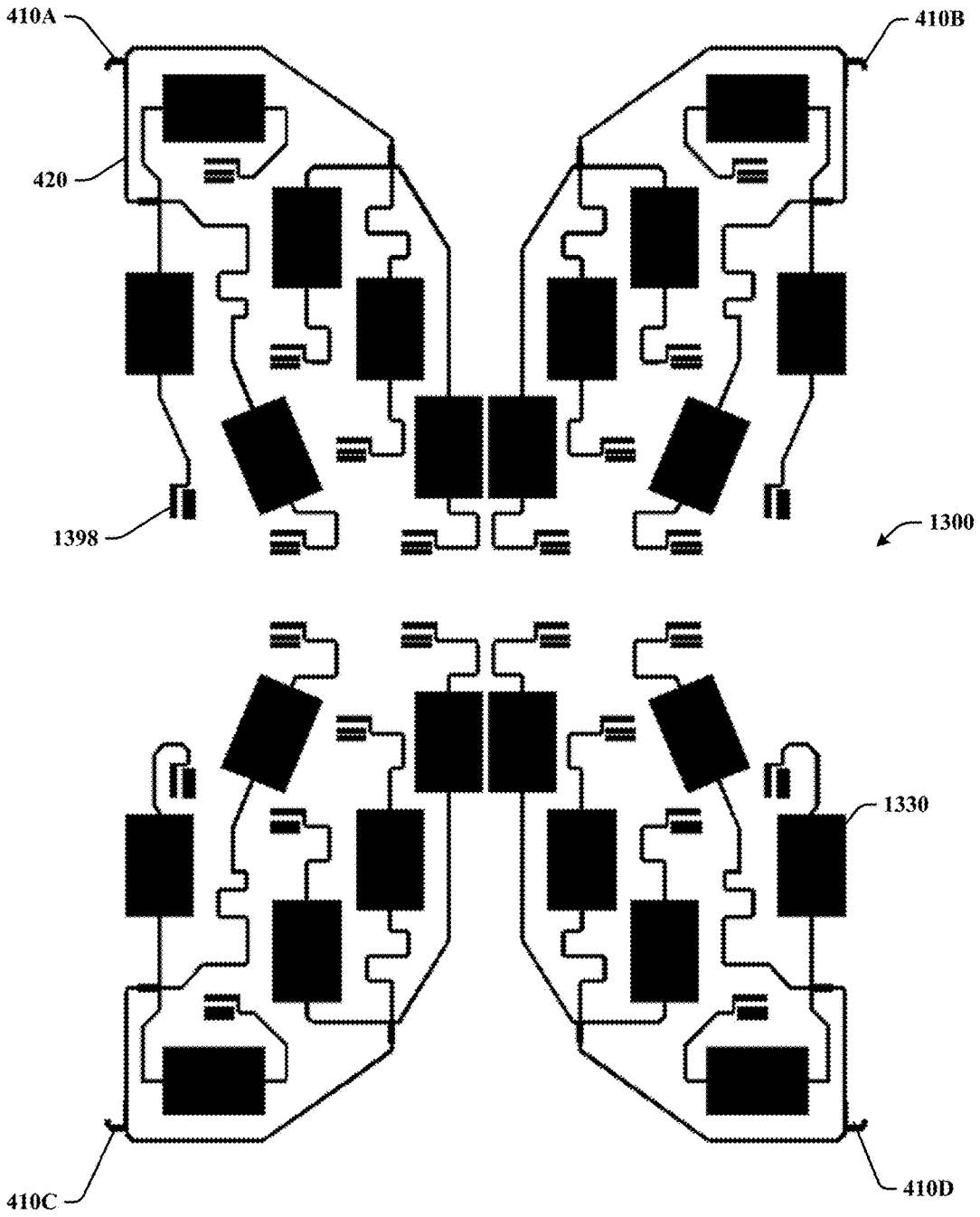
FIG. 13 is a block diagram illustrating an exemplary T/R module placement for utilization in mitigation/reduction of SSL during operation of an antenna array.

FIG. 13 illustrates an array layout 1300 for T/R module placement according to an embodiment. FIG. 13 can be viewed in conjunction with FIGS. 4, 5, and 8, where FIG. 13 illustrates the pre-T/R feed networks, e.g., the electrical circuits and components between any of input ports 410A-410D to a stripline-to-stripline transition component (e.g., stripline-to-stripline transition component 1398). To facilitate understanding of one or more embodiments presented herein, with reference to FIG. 8, which partially illustrates the post T/R feed network, the pre-T/R feed network 1300 presented in FIG. 13 can be laid over the post-T/R feed network 800 (e.g., stripline-to-stripline transition component 1398 can be located over stripline-to-stripline transition component 898), as partially depicted in FIG. 4.

A plurality of T/R modules 1330 are depicted (e.g., comparable to T/R modules 430 presented in FIG. 4), whereby, in an embodiment, each T/R module 1330 can comprise a pair of RF switches, a power amplifier and a low noise amplifier. As mentioned previously, all of the T/R modules 1330 are identical and are operated with the same bias conditions and input power levels. In an embodiment, the various amplifiers included in the plurality of T/R modules can be collectively operated under compressive load to a 1 dB compression point. Operation of the various amplifiers (and associated T/R modules) in such a manner can yield improved amplitude and phase stability over a plurality of frequency ranges and/or a plurality of temperature gradients that an array may be operating under.

Figure 14:
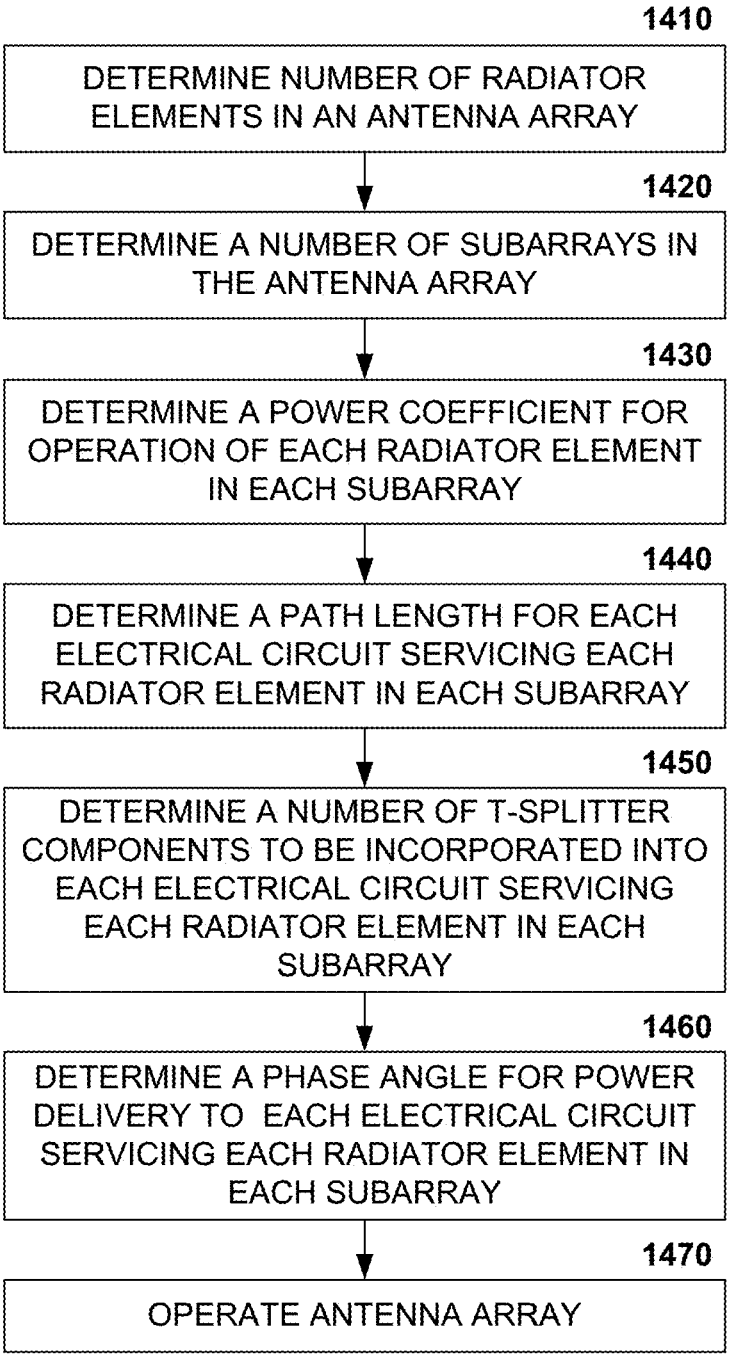
FIG. 14 is a flow diagram illustrating an exemplary methodology for mitigating/reducing SSL during operation of an antenna array.
Figure 15:
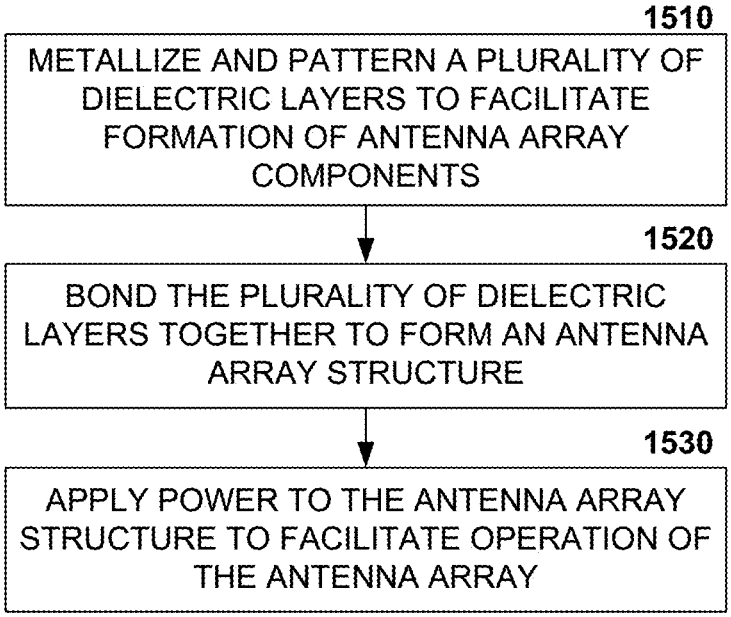
FIG. 15 is a flow diagram illustrating an exemplary methodology for mitigating/reducing SSL during operation of an antenna array.
Figure 16:
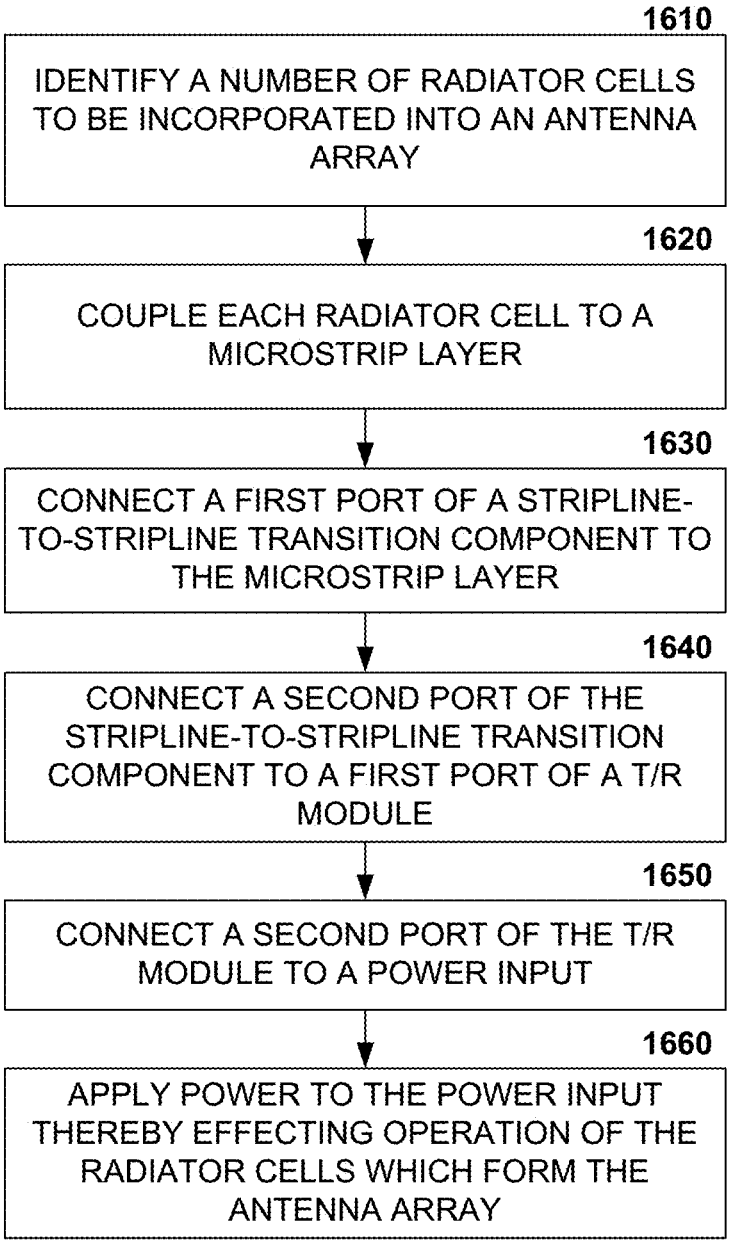
FIG. 16 is a flow diagram illustrating an exemplary methodology for mitigating/reducing SSL during operation of an antenna array.

FIGS. 14-16 illustrate exemplary methodologies relating to reducing/mitigating SSL during operation of an antenna array. While the methodologies are shown and described as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement the methodologies described herein.

FIG. 14 illustrates an exemplary methodology 1400 for reducing/mitigating SSL during operation of an antenna array. At 1410 a number of radiator elements to be utilized in an antenna array is determined. As previously described, a radiator element can include an antenna element along with any associated circuitry and or components required to facilitate operation of the antenna element. For example, a radiator element can include a microstrip layer utilized to electrically couple the antenna element to associated componentry to facilitate transmission and reception of electromagnetic signals via the antenna element.

At 1420, a number of antenna subarrays in the antenna array can be determined, wherein each antenna subarray can comprise one or more radiator elements. A conventional antenna array may be operated whereby all of the radiator elements comprising the antenna array are operated equally, e.g., with the same power coefficient(s). However, such conventional operation can lead to formation of unwanted SSL which can affect the efficiency and sensitivity of the antenna array in a preferred direction of operation (e.g., a mainlobe direction). In an embodiment, as described herein, an antenna array can be divided into a plurality of subarrays of one or more radiator elements, whereby each subarray can be effectively operated in isolation from any neighboring/adjacent subarrays.

At 1430, as part of determining a number of antenna subarrays to be utilized, power coefficients to be applied to each of the radiator elements comprising each subarray can also be determined. The power coefficients in conjunction with the subarrays can be utilized to effect aperture taper of the antenna array. For example, radiator elements that are located at, or near to, the center of the antenna array are probably to be operated with the highest power coefficient(s) thereby enabling a mainlobe to be formed in the central region of the antenna array. As the antenna array is positioned with respect to an electromagnetic receiver or electromagnetic source (e.g., the operating surface of the antenna array is positioned perpendicular to the receiver/source) the mainlobe can be focused upon the receiver/source. To prevent unwanted signal losses (e.g., SLLs) or interference, it is desired that any sidelobe signals are kept to a minimum. In a conventional system, one or more attenuators can be utilized to suppress sidelobe generation, however, as previously described, attenuators may require power that places an operational strain on equipment associated with the antenna array (e.g., a UAV having limited available power). Thus, rather than utilize attenuators or similar apparatus for signal suppression, the power coefficients associated with the respective radiator elements can be tapered in relation to the distance of a respective radiator element to those radiator elements operating to form a mainlobe. Accordingly, as the respective distance between a radiator element and the central radiator elements increases the power coefficient applied to the radiator element can be reduced. As previously mentioned, radiator elements which are centrally located in the antenna array can operate with a maximum power coefficient, e.g., a power coefficient of one or unity. Power coefficients of other, non-centrally located radiator elements, can be tapered off in accordance with a number of radiator elements comprising a subarray (e.g., the greater the number of radiator elements comprising a subarray, the greater the number of radiator elements a given power is to be shared amongst with an according reduction in power coefficient for each radiator element).

At 1440, along with the function of as a number of radiator elements comprising a subarray increases there is an according reduction in available power per radiator element, the power coefficient can be further modified by altering the electrical path length servicing a first radiator element in comparison with the path length servicing a second radiator element. As the electrical path length is increased, e.g., a first electrical path length servicing the first radiator element is longer than a second electrical path length servicing the second radiator element, then the power coefficient accordingly reduces. Continuing the example further, the first radiator element has a lower power coefficient than then second radiator element.

At 1450, a power coefficient can be further affected by the number of T-splitters which have been incorporated into an electrical path. For example, while two electrical circuits may have the same path length, where the first electrical circuit has more T-splitters incorporated into the circuit in comparison with a second electrical circuit having fewer incorporated T-splitters, the power coefficient of the first electrical circuit is reduced in comparison with the second electrical circuit. T-splitters incorporated into an electrical path have no magnitude or phase differences between their two insertion paths which further minimizes the generation and/or magnitude of a sidelobe(s) as any error, particularly phase error between a first feed line and a second feed line, are prevented.

At 1460, owing to the difference in respective path lengths between a radiator element and a stripline-to-stripline component operating in association with the radiator element, as previously described herein, a phase delay can be determined for each radiator element to facilitate delivery of power to the plurality of radiator elements comprising an antenna array at the same time, e.g., power delivered to a centrally located first radiator element having a short electrical path, and according high power coefficient, arrives at the first radiator element concurrent with a power delivered to a second radiator element located on the periphery of the antenna array, where the electrical path to the second radiator element is longer than that utilized for the first radiator element.

At 1470, the antenna array is operated in accordance with the tapered aperture resulting from the tapered power coefficients in accordance with the path length(s), number of T-splitters, and phase angle as previously described.

FIG. 15 illustrates a methodology 1500 for construction of an apparatus to facilitate reducing/mitigating SSL during operation of an antenna array. As previously described, a conventional approach for construction of an apparatus for utilization in a conventional antenna array is a laminated structure whereby vias or other interconnecting structures are utilized to electrically connect a first layer in the laminated structure, e.g., where the first layer is a grounding layer, with a second layer in the laminated structure, e.g., where the second layer is an antenna layer. However, utilizing vias or other interconnects can result in a complicated/costly manufacturing process as well as give rise to subsequent failure of an antenna array during operation (e.g., owing to thermal expansion/contraction of the various components/layers comprising the antenna array during operation of the antenna array). Accordingly, it would be of benefit to construct an antenna array without the requirement for vias or other interconnects.

At 1510 a plurality of dielectric layers can be metallized and patterned to form respective components which will form an antenna array. As previously mentioned, a dielectric material (e.g., PTFE) can be utilized which exhibits dielectric properties in a frequency range of interest (e.g., $K_u$ band, or approx. 12-18 GHz). Utilization of such a dielectric material removes a requirement for vias or other interconnects in the antenna array, as during operation (e.g., at the $K_u$ frequency bandrange) components comprising a first layer can be electrically coupled to a second layer across the dielectric material (e.g., by proximity coupling). As previously described herein, a number of components and associated circuitry can be patterned in the metallized layer(s). For example, depending upon the respective metallized layer any of the following components/circuitry can be formed: at least one electrical path/circuit, at least one pre-T/R stripline, at least one post-T/R stripline, at least one grounding circuit (e.g., a H-shaped slot ground), at least one radiator element, at least one antenna (e.g., a U-slot patch antenna), at least one T-splitter, at least one stripline-to-stripline transition component, at least one top stripline component, at least one bottom stripline component, an intermittent slotline, at least one input port, etc., as required to facilitate operation of one or more embodiments presented herein.

It is to be appreciated that while the formation of the various components comprising an antenna array are described above, there may be certain procedures that are not fully disclosed during description of the various embodiments as presented herein. However, rather than provide description of each and every operation involved in the various operations facilitating formation, patterning, removal, etc., of each structure presented herein, for the sake of description only the general operations are described. Hence, while no mention may be presented regarding a particular operation pertaining to aspects of a particular figure, it is to be appreciated that any necessary operation, while either not fully disclosed, or not mentioned, to facilitate formation/deconstruction of a particular layer/element/aspect presented in a particular figure is considered to have been conducted. It is appreciated that the various operations, e.g., leveling, chemical mechanical polish, patterning, photolithography, deposition, layer formation, etching, etc., are well known procedures and are not necessarily expanded upon throughout this description.

At 1520, upon formation of the respective components comprising the antenna array are formed (e.g., patterned, deposited, etc.) the various dielectric layers are bonded together to form an antenna array comprising the required components to facilitate operation of one or more embodiments as presented herein. For example, a pre-T/R stripline is fixed in proximity to a post-T/R stripline (with a shared ground located therebetween) to facilitate, during operation of the antenna array, electrical coupling between the pre-T/R stripline and the post-T/R stripline.

At 1530, power is applied to the antenna array structure to facilitate operation of the antenna array. As previously described, in a transmission operation, power can be applied to an input port, with the power being conveyed (e.g., via a T/R module) to a pre-T/R stripline. The pre-T/R stripline is electrically coupled to a post-T/R stripline, which upon application of power, the port-T/R stripline is further electrically coupled to a microstrip layer and a radiating element. Energization of the microstrip layer directs the power to an antenna in the radiating element, whereupon the electrical power is transformed to electromagnetic energy and a RF signal is transmitted from the antenna.

FIG. 16 illustrates a methodology 1600 for construction of an apparatus to facilitate reducing/mitigating SSL during operation of an antenna array. At 1610 a number of radiator elements to be utilized in an antenna array is determined. As previously described, a radiator element can comprise of an antenna element along with any associated circuitry and or components required to facilitate operation of the antenna element.

At 1620, a radiator element is coupled to a microstrip layer utilized to facilitate electrically coupling the antenna element to associated componentry to facilitate transmission and reception of electromagnetic signals via the antenna element.

At 1630, a first portion (e.g., a top stripline) of a stripline-to-stripline transition component is connected to the microstrip layer. As previously described, the first portion of the stripline-to-stripline transition component can be connected to the microstrip layer via a post-T/R feed network (also termed an irregular-subarray feed network), where the post-T/R feed network can be of a determined electrical path length and further have incorporated therein at least one T-splitter component (except for a subarray comprising a single radiator element, as previously described, where no T-splitter component is utilized). The electrical path length and number of T-splitter components incorporated into the post-T/R feed network is a function of the desired power coefficient to be utilized as part of the operation of the radiator element, as previously described.

At 1640, a second portion (e.g., a bottom stripline) of the stripline-to-stripline transition component is connected to a first port of a T/R module circuit. As previously described, each T/R module can be identical with every other T/R module and are operated with the same bias condition(s) and input power level.

At 1650, a second port of the T/R module circuit is connected to a power input port.

At 1660, power is applied to the circuit constructed in acts 1610-1650 to facilitate operation of the antenna array in accordance with one or more embodiments as previously described.

What has been described above includes examples of one or more embodiments. It is, of course, not possible to describe every conceivable modification and alteration of the above structures or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. An antenna array, comprising:

a plurality of antenna subarrays, the plurality of antenna subarrays are located around a central point in the antenna array, wherein the plurality of antenna subarrays comprises:

a first antenna subarray comprising at least one antenna element;

a second antenna subarray comprising a first plurality of antenna elements; and a third antenna subarray comprising a second plurality of antenna elements, wherein the second antenna subarray includes a greater number of antenna elements than the first antenna subarray, the third antenna subarray comprises a greater number of antenna elements than the second subarray, the first antenna subarray is located closer to the center point of the antenna array than the second antenna subarray, the second antenna subarray is located closer to the center point of the antenna array than the third antenna subarray, each antenna element in the first antenna subarray, the second antenna subarray, and the third antenna subarray has a power coefficient, wherein the sum of the antenna power coefficients of the at least one antenna element in the first antenna subarray is greater than the sum of the antenna power coefficients of the first plurality of antenna elements in the second antenna subarray, and further wherein the sum of the antenna power coefficients of the first plurality of antenna elements in the second antenna subarray is greater than the sum of the antenna power coefficients of the second plurality of antenna elements in the third antenna subarray.

2. The antenna array of claim 1, wherein a first radiator element and a second radiator element in the second antenna subarray are connected via a common stripline-to-stripline interconnect, the first radiator element having a first power coefficient and the second radiator element having a second power coefficient that is different from the first power coefficient, wherein the stripline-to-stripline interconnect comprises a pre-transmit/receive (T/R) stripline layer, a post-T/R stripline layer, and a common ground layer, the pre-transmit/receive (T/R) stripline layer and the post-T/R stripline layer electrically couple via the ground layer, and the pre-T/R stripline layer is connected to an input port.

3. The antenna array of claim 2, wherein the first power coefficient is a function of a first electrical path length between the first radiator element and the input port, and the second power coefficient is a function of a second electrical path length between the second radiator element and the input port.

4. The antenna array of claim 2, wherein the first power coefficient is a function of a first number of T-splitter components located in a first electrical path between the first radiator element and the post-T/R stripline layer and the second power coefficient is a function of a second number of T-splitter components located in a second electrical path between the second radiator element and the post-T/R stripline layer.

5. The antenna array of claim 4, wherein the T-splitter components are 50/50 junction splitters, electrical energy arriving at the T-splitter components is split equally between the first electrical path connecting the first radiator element and the second electrical path connecting the second radiator element.

6. The antenna array of claim 4, wherein the electrical coupling between the post-T/R stripline layer and the pre-T/R stripline layer is facilitated by a dielectric material.

7. The antenna array of claim 6, wherein the dielectric material comprises polytetrafluoroethylene.

8. The antenna array of claim 2, wherein the power coefficient facilitates operation of the antenna array at a frequency of between 12 GHz and 18.2 GHz.

9. The antenna array of claim 2, wherein the power coefficient facilitates operation of the antenna array with a sidelobe magnitude of −30 dB relative to the magnitude of a mainlobe generated during operation of the antenna array.

10. The antenna array of claim 2, further comprising a dielectric layer that is configured to be polarized when energy at a frequency of about 12-18 GHz is applied thereto, wherein in the polarized state the dielectric layer facilitates electrical coupling of the pre-T/R stripline layer and the post-T/R stripline layer.

* * * * *